US011821393B1

(12) United States Patent
Islam et al.

(10) Patent No.: US 11,821,393 B1
(45) Date of Patent: Nov. 21, 2023

(54) INTEGRATED INTAKE MANIFOLD

(71) Applicant: Ford Global Technologies, LLC, Dearborn, MI (US)

(72) Inventors: Md-Tofiqul Islam, Rochester Hills, MI (US); Behrooz Khatib-Shahidi, Novi, MI (US); Bakhtyar Baig, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 18/046,846

(22) Filed: Oct. 14, 2022

(51) Int. Cl.
*F02M 35/10* (2006.01)
*F02M 35/104* (2006.01)

(52) U.S. Cl.
CPC .... *F02M 35/10321* (2013.01); *F02M 35/104* (2013.01); *F02M 35/1036* (2013.01); *F02M 35/10255* (2013.01)

(58) Field of Classification Search
CPC ..... F02M 35/10321; F02M 35/10255; F02M 35/1036; F02M 35/104; F02M 35/10314
See application file for complete search history.

(56) References Cited

U.S. PATENT DOCUMENTS

| | | | | |
|---|---|---|---|---|
| 6,427,975 | B1 * | 8/2002 | Powell | F16K 27/0218 251/305 |
| 7,328,507 | B2 | 2/2008 | Arai et al. | |
| 8,360,025 | B2 | 1/2013 | Newman et al. | |
| 9,233,493 | B2 | 1/2016 | Schwulst | |
| 2008/0295800 | A1 | 12/2008 | Bolinger | |
| 2009/0308349 | A1 * | 12/2009 | Apel | F02D 9/1005 123/337 |
| 2015/0300298 | A1 | 10/2015 | Mellere et al. | |
| 2017/0310188 | A1 * | 10/2017 | Snelick | H02K 5/16 |
| 2020/0412096 | A1 * | 12/2020 | Stancavage | F02M 35/1034 |

* cited by examiner

*Primary Examiner* — Jacob M Amick
(74) *Attorney, Agent, or Firm* — Vincent Mastrogiacomo; McCoy Russell LLP

(57) ABSTRACT

Systems and methods for directing and controlling air flow into an internal combustion engine are presented. In one example, an aluminum cylinder with two welded bearing holders is over molded with a short fiber reinforced polymer composite throttle body housing. The short fiber reinforced polymer composite throttle body housing may be welded to an engine intake manifold or it may be part of the engine intake manifold.

16 Claims, 7 Drawing Sheets

INTEGRATED INTAKE MANIFOLD

FIELD

The present description relates to an integrated intake manifold for an internal combustion engine.

BACKGROUND AND SUMMARY

An intake manifold may be bolted to an engine during assembly of the engine. A throttle body may be bolted to the intake manifold after the intake manifold is bolted to the engine or prior to the intake manifold being bolted to the engine. Throttle bodies often include four bolts and a gasket to prevent air entry into the engine at the seam that is between the throttle body and the intake manifold. However, the bolts and gasket add to system cost and may make it possible for vehicle operation to become degraded due to a misaligned seal and/or loose bolts. Therefore, it may be desirable to provide an intake manifold that reduces the possibility of a misaligned seal and/or loose throttle fastening bolts.

The inventors herein have recognized the above-mentioned issues and have developed a system for directing and controlling air flow into an internal combustion engine, comprising: a short fiber reinforced polymer composite intake manifold and a short fiber reinforced polymer composite throttle body housing, where the short fiber reinforced polymer composite throttle body housing is molded over an aluminum cylinder that includes two bearing holders.

By combining a short fiber reinforced polymer composite throttle body housing with a short fiber reinforced polymer composite intake manifold, it may be possible to provide the technical result of eliminating bolts and a sealing gasket between a throttle body and an intake manifold. In particular, a composite throttle body housing may be welded to a composite intake manifold to eliminate bolts and gaskets between the components. Alternatively, the throttle body housing and the intake manifold may be constructed as a unit to eliminate throttle housing bolts and gaskets.

The present description may provide several advantages. In particular, the approach may reduce parts and costs of generating an engine air intake system. Further, the approach may reduce a possibility of engine emissions degradation that may be associated with a misaligned throttle body gasket. Additionally, the approach may reduce weight of an engine air intake system.

The above advantages and other advantages, and features of the present description will be readily apparent from the following Detailed Description when taken alone or in connection with the accompanying drawings.

It may be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
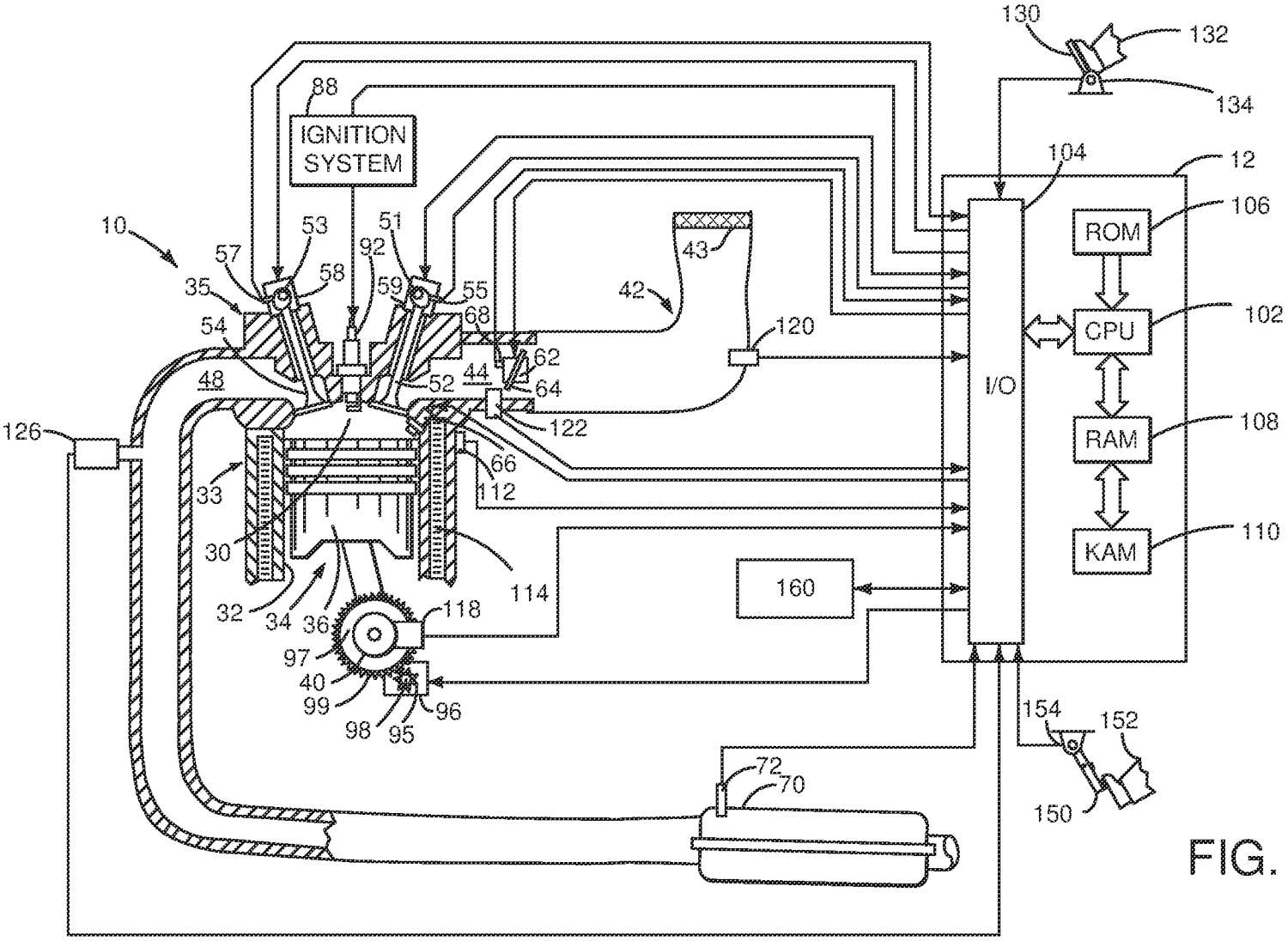
FIG. 1 is a schematic diagram of an engine.
Figure 2:
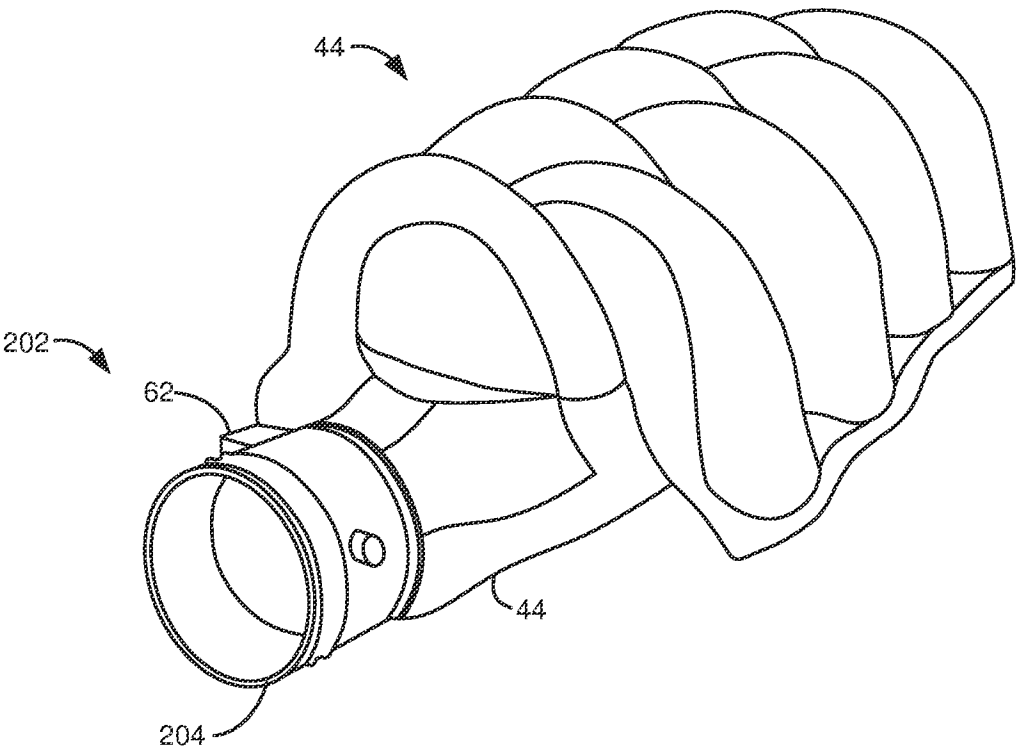
FIG. 2 is a perspective view of an integrated throttle body and intake manifold.
Figure 3:
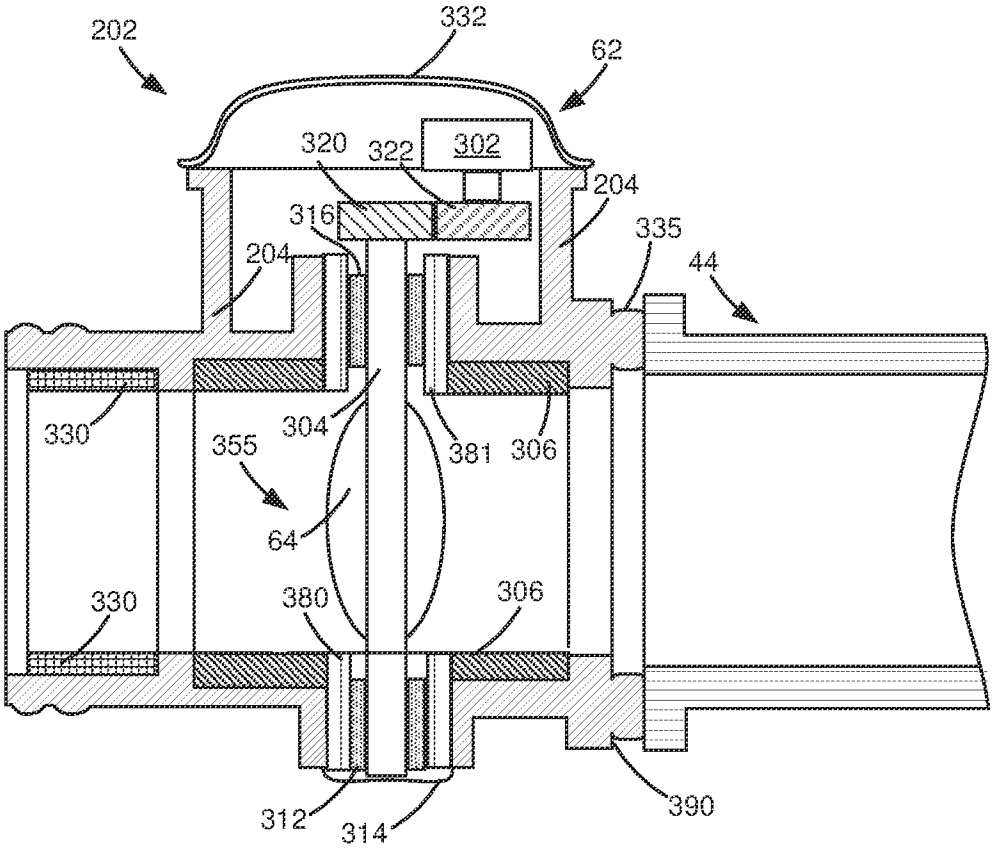
FIG. 3 shows a cross-section of an example throttle body
Figure 4:
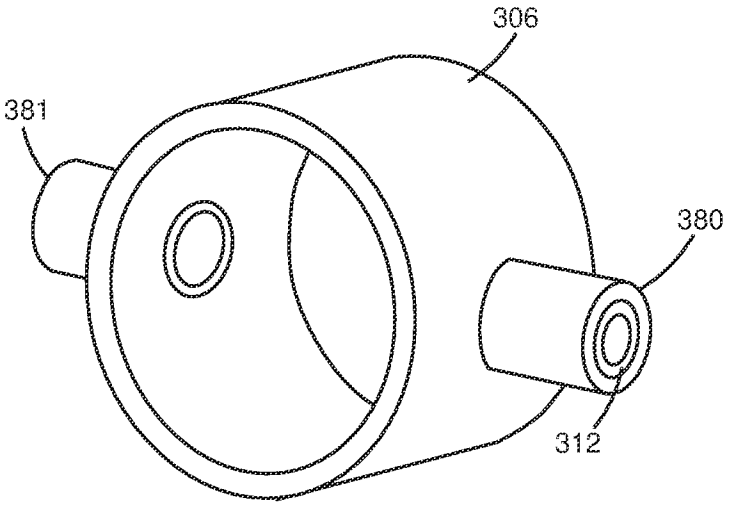
FIG. 4 shows a perspective view of a cylinder that is over molded with a throttle body housing.
Figure 5:
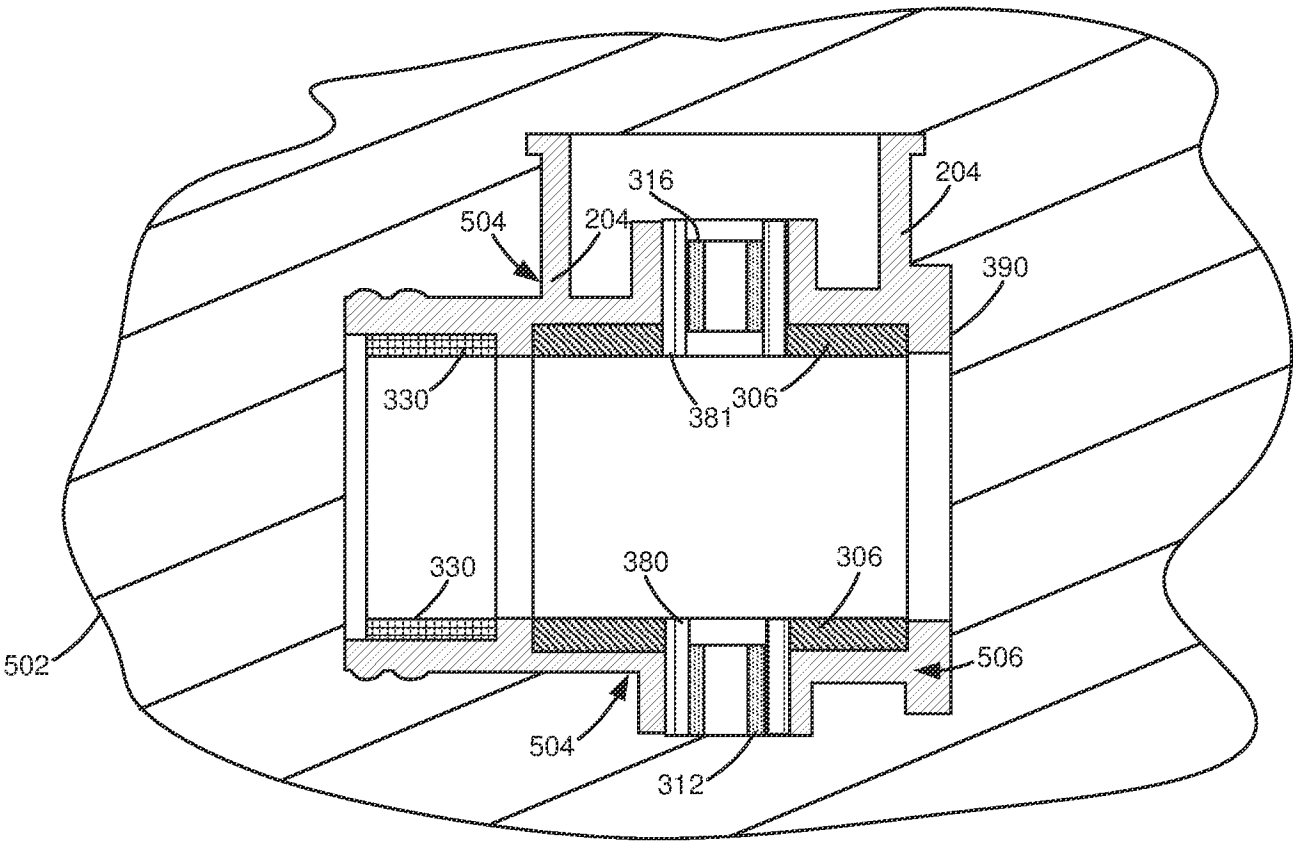
FIG. 5 shows an example throttle body that may be welded to an intake manifold.
Figure 6:
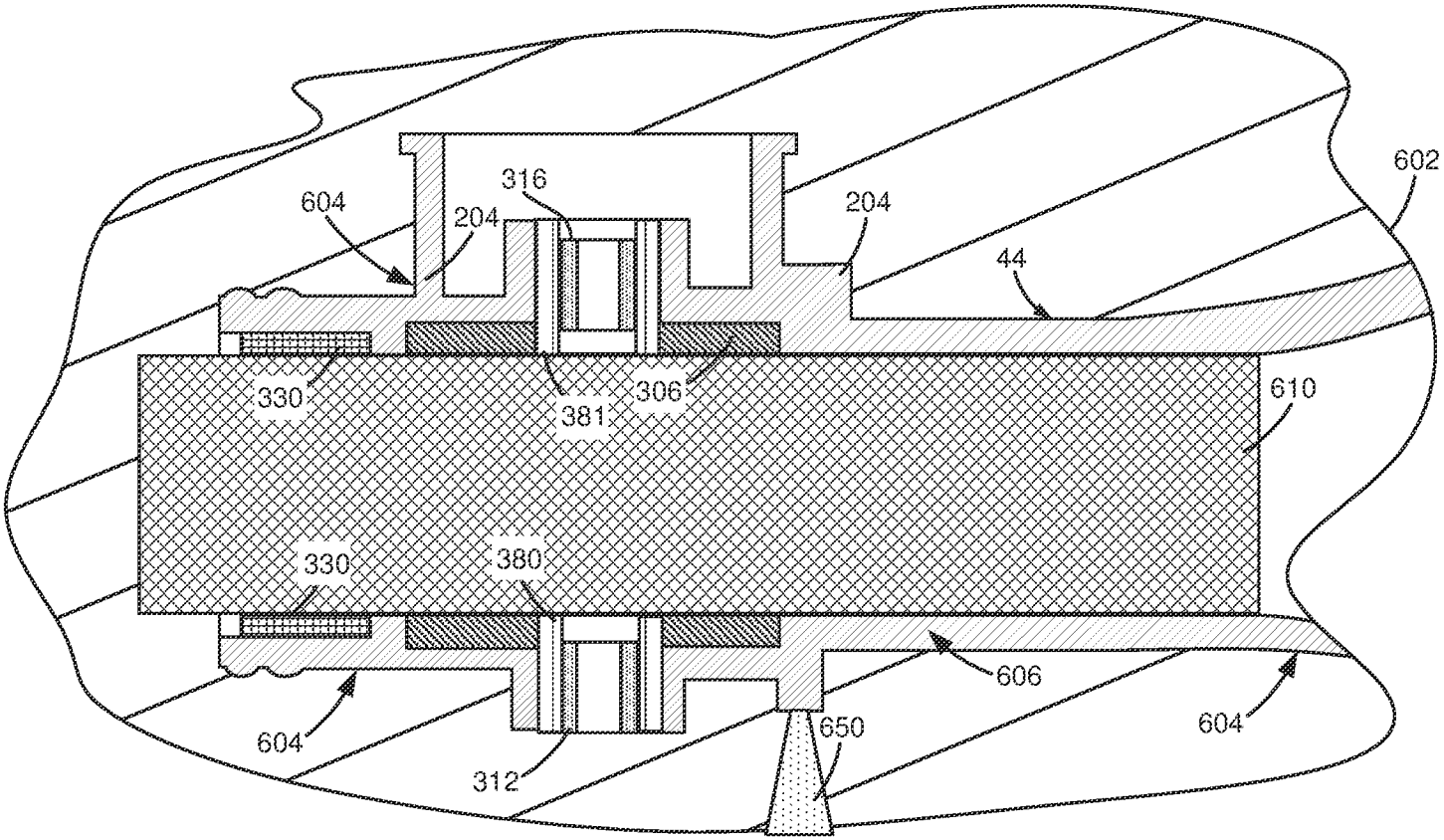
FIG. 6 shows an example throttle body that is constructed as a unit with an engine intake manifold.

The present description is related to reducing cost of an engine air intake system. An engine air intake system may include a composite throttle body housing that is molded over an aluminum cylinder to reduce system cost and maintain system rigidity. The composite throttle body may be welded to an intake manifold or it may be included as a single unit with an engine intake manifold. The throttle body and intake manifold may be incorporated into an internal combustion engine as shown in FIG. 1. The throttle body and intake manifold may be integrated as shown in FIGS. 2, 3, and 6. The throttle body may be molded over an aluminum cylinder of the type that is shown in FIG. 4. In some examples, the throttle body may be manufactured apart from the intake manifold as shown in FIG. 5 via the method of FIG. 7. The throttle body may be welded to the intake manifold as shown in FIG. 3 when the throttle body is manufactured apart from the intake manifold.

Referring to FIG. 1, engine 10 (e.g., an internal combustion engine), comprising a plurality of cylinders, one cylinder of which is shown in FIG. 1, is controlled by electronic controller 12 (e.g., an engine controller). Engine 10 is comprised of cylinder head 35 and block 33, which include combustion chamber 30 and cylinder walls 32. Piston 36 is positioned therein and reciprocates via a connection to crankshaft 40. Flywheel 97 and ring gear 99 are coupled to crankshaft 40. Flywheel starter 96 (e.g., low voltage (operated with less than 30 volts) electric machine) includes pinion shaft 98 and pinion gear 95. Pinion shaft 98 may selectively advance pinion gear 95 to engage ring gear 99. Flywheel starter 96 may be directly mounted to the front of the engine or the rear of the engine. In some examples, flywheel starter 96 may selectively supply torque to crankshaft 40 via a band or chain. In one example, flywheel starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation device 59. Exhaust valve 54 may be selectively activated and deactivated by valve activation device 58. Valve activation devices 58 and 59 may be hydraulic and/or electro-mechanical devices.

Fuel injector 66 is shown positioned to inject fuel directly into cylinder 34, which is known to those skilled in the art as direct injection. Fuel injector 66 delivers liquid fuel in proportion to the pulse width from controller 12. Fuel is delivered to fuel injector 66 by a fuel system (not shown) including a fuel tank, fuel pump, and fuel rail (not shown).

In one example, a high pressure, dual stage, fuel system may be used to generate higher fuel pressures.

In addition, intake manifold 44 is shown communicating with engine air intake 42. Optional electronic throttle 62 adjusts a position of throttle plate 64 to control air flow from engine air intake 42 to intake manifold 44. Air filter 43 cleans air entering engine air intake 42.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Catalytic converter 70 can include multiple catalyst bricks, in one example. In another example, multiple emission control devices, each with multiple bricks, can be used. Catalytic converter 70 can be a three-way type catalyst in one example. Temperature of catalytic converter 70 (e.g., catalyst) may be monitored via temperature sensor 72.

Controller 12 may receive input data from and provide output data to human/machine interface 160. Human/machine interface 160 may be a touch screen display, key board, or other known interface. Controller 12 may provide and display system status information via human/machine interface 160. A human user may input requests for powertrain and passenger cabin climate controls to human/machine interface 160.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an driver demand pedal 130 for sensing force applied by foot 132; a position sensor 154 coupled to brake pedal 150 for sensing force applied by foot 152, a measurement of engine manifold pressure (MAP) from pressure sensor 122 coupled to intake manifold 44; an engine position sensor from a position sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2, a perspective view of a throttle body assembly 202 is shown. In some examples, throttle body assembly 202 includes an electronically controlled throttle 62 and a throttle body housing 204. The throttle body assembly 202 may be welded to engine intake manifold 44. Alternatively, throttle body assembly 202 may be included with short fiber reinforced polymer composite throttle body housing 204 and engine intake manifold 44, where short fiber reinforced polymer composite throttle body housing 204 and engine intake manifold 44 of unitary construction. In this example, engine intake manifold 44 is configured for a V8 engine, but throttle body housing 204 and intake manifold 44 may be configured for a fewer or greater number of engine cylinders (e.g., 1-6 or 12).

Turning now to FIG. 3, a cross section of a first example of throttle body assembly 202 is shown. In this example, throttle body assembly 202 is welded to intake manifold 44. Throttle body assembly 202 includes an electronically controlled throttle 62. Electronically controlled throttle 62 includes a motor 302 (e.g., an electric machine) and gears 322 and 320. Gears 320 and 322 couple motor 302 to shaft 304 and throttle plate 64. Motor 302 may selectively rotate shaft 304 and throttle plate 64 to allow or prevent air flow into engine 10 of FIG. 1 via opening and closing throttle bore 355.

Aluminum cylinder 306 and steel sleeve 330 are over molded by short fiber reinforced polymer composite throttle body housing 204. Aluminum cylinder 306 includes first bearing holder 380 and second bearing holder 381. The bearing holders may be constructed of aluminum and they may be welded to aluminum cylinder 306. Steel bearings 312 and 316 are positioned within bearing holders 380 and 381 as shown to permit shaft 304 to rotate. Bearing cap 314 is attached to short fiber reinforced polymer composite throttle body housing 204 and it covers bearing 312. Motor housing cap 332 covers motor 302 and is attached to short fiber reinforced polymer composite throttle body housing 204.

Short fiber reinforced polymer composite throttle body housing 204 is shown vibration welded to engine intake manifold 44, which may be constructed of short fiber reinforced polymer composite material. Weld bead 335 is shown joining flange 390 of short fiber reinforced polymer composite throttle body housing 204 and engine intake manifold 44.

Moving on to FIG. 4, a perspective view of aluminum cylinder 306 is shown. Bearing holders 380 and 381 are shown in a horizontal orientation, but they may be positioned in a vertical orientation in other examples. Bearing holders 380 and 381 are formed in the shape of a cylinder. Steel bearing 312 is shown as being supported by bearing holder 380.

Referring now to FIG. 5, a schematic via of an example throttle body that may be welded to an intake manifold is shown. In this example, exterior 504 of short fiber reinforced polymer composite throttle body housing 204 conforms to a shape of injection mold 502. An inner mold core (not shown) may support steel sleeve 330 and aluminum cylinder 306 during manufacturing when a short fiber reinforced polymer composite 506 is injected into injection mold 502.

Aluminum cylinder 306 and steel sleeve 330 are over molded by short fiber reinforced polymer composite throttle body housing 204. Likewise, first bearing holder 380 and second bearing holder 381 are at least partially over molded by short fiber reinforced polymer composite throttle body housing 204. Aluminum cylinder 306 and steel sleeve 330 provide support to reduce deflection of short fiber reinforced polymer composite throttle body housing 204. First bearing holder 380 and second bearing holder 381 provide support for bearings 312 and 316. Over molded by short fiber reinforced polymer composite throttle body housing 204 allows the throttle body assembly weight to be reduced. Joining flange 390 allows short fiber reinforced polymer composite throttle body housing 204 to be welded to an engine intake manifold so as to prevent air flow between the short fiber reinforced polymer composite throttle body housing 204 and an engine intake manifold (not shown).

Referring now to FIG. 6, a schematic via of an example throttle body that is part of or integrated with an intake manifold is shown. In this example, exterior 604 of short fiber reinforced polymer composite throttle body housing 204 and short fiber reinforced polymer composite engine intake manifold 44 conforms to a shape of injection mold 602. An inner mold core 610 supports steel sleeve 330 and aluminum cylinder 306 during manufacturing when a short fiber reinforced polymer composite 606 is injected into injection mold 602.

Aluminum cylinder 306 and steel sleeve 330 are over molded by short fiber reinforced polymer composite throttle body housing 204. Similarly, first bearing holder 380 and second bearing holder 381 are at least partially over molded by short fiber reinforced polymer composite throttle body housing 204. Aluminum cylinder 306 and steel sleeve 330 provide support to reduce deflection of short fiber reinforced polymer composite throttle body housing 204. First bearing holder 380 and second bearing holder 381 provide support for bearings 312 and 316. Over molded by short fiber reinforced polymer composite throttle body housing 204 allows the throttle body assembly weight to be reduced. Short fiber reinforced polymer composite throttle body housing 204 is integral with short fiber reinforced polymer composite engine intake manifold 44 such that there is no seem between the two intake system portions. Injection mold 602 includes an injection molding gate so that short fiber reinforced polymer composite 606 may be injected in to form integrated short fiber reinforced polymer composite throttle body housing 204 and short fiber reinforced polymer composite engine intake manifold 44.

Thus, the system of FIGS. 1-6 provides for a system for directing and controlling air flow into an internal combustion engine, comprising: a short fiber reinforced polymer composite intake manifold and a short fiber reinforced polymer composite throttle body housing, where the short fiber reinforced polymer composite throttle body housing is molded over an aluminum cylinder that includes two bearing holders. In a first example, the system includes where the short fiber reinforced polymer composite intake manifold is welded to the short fiber reinforced polymer composite throttle body housing. In a second example that may include the first example, the system includes where the short fiber reinforced polymer composite intake manifold and the short fiber reinforced polymer composite throttle body housing are an one piece unit. In a third example that may include one or both of the first and second examples, the system further comprises two bearings and a shaft. In a fourth example that may include one or more of the first through third examples, the system includes where the two bearing holders are welded to the aluminum cylinder. In a fifth example that may include one or more of the first through fourth examples, the system further comprises a metal sleeve, and where the short fiber reinforced polymer composite throttle body housing is molded over the metal sleeve. In a sixth example that may include one or more of the first through fifth examples, the system further comprises a flange included in the short fiber reinforced polymer composite throttle body housing, and wherein the short fiber reinforced polymer composite intake manifold is welded to the flange.

Thus, the system of FIGS. 1-6 provides for a throttle body for an internal combustion engine, comprising: a short fiber reinforced polymer composite throttle body housing molded over an aluminum cylinder that includes two bearing holders. In a first example, the throttle body includes where the two bearing holders are welded to the aluminum cylinder. In a second example that may include the first example, the throttle body further comprises a first bearing installed in a first of the two bearing holders and a second of the two bearing holders installed in a second of the two bearing holders. In a third example that may include one or both of the first and second examples, the throttle body further comprises a short fiber reinforced polymer composite engine intake manifold welded to the short fiber reinforced polymer composite throttle body housing. In a fourth example that may include one or more of the first through third examples, the throttle body further comprises an over molded steel sleeve.

FIGS. 2-6 are drawn approximately to scale. However, the intake and throttle assembly may have other relative components dimensions in alternate embodiments.

Figure 7:
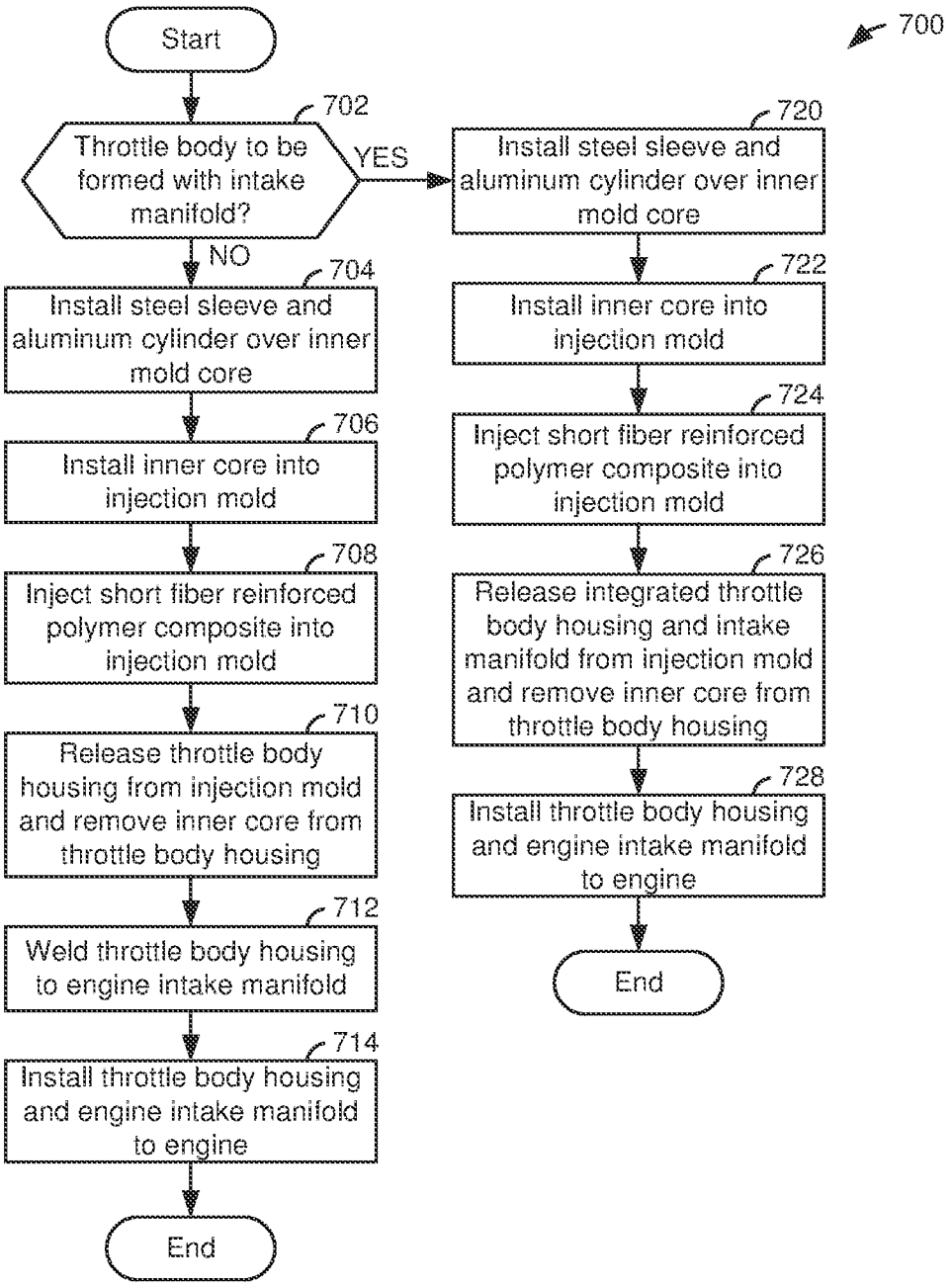
FIG. 7 shows a flowchart of a method to manufacture a throttle body assembly.

Referring now to FIG. 7, a method for manufacturing an integrated engine intake manifold and throttle body is shown. The method of FIG. 7 may include actions taken in the physical world by one or more machines and/or humans to construct an integrated engine intake manifold that includes a throttle body.

At 702, method 700 judges if a throttle body is to be formed with an engine intake manifold. If so, the answer is yes and method 700 proceeds to 720. Otherwise, the answer is no and method 700 proceeds to 704.

At 704, a steel sleeve (e.g., a steel cylinder) and an aluminum cylinder are installed over an inner mold core. The inner mold core fills the air that air will flow through the throttle body. Method 700 proceeds to 706.

At 706, the inner mold core, steel sleeve, and aluminum cylinder are installed into an injection mold. Method 700 proceeds to 708.

At 708, a short fiber reinforced polymer composite is injected into the injection mode and it is allowed to cure to a solid. Method 700 proceeds to 710.

At 710, the throttle body that is formed from the short fiber reinforced polymer composite is released from the mold and the inner core is removed from the throttle body. Method 700 proceeds to 712.

At 712, the throttle body made of short fiber reinforced polymer composite material is vibration welded to an engine intake manifold that is made of short fiber reinforced polymer composite material. The vibration weld removes any gap or space between the throttle body and the engine intake manifold so that there is a seal between the throttle body and the engine intake manifold. Additionally, a motor, gears, throttle plate, and shaft may be installed into the throttle body. Method 700 proceeds to 714.

At 714, the integrated throttle body and engine intake manifold are bolted to an engine. Method 700 proceeds to exit.

At 720, a steel sleeve (e.g., a steel cylinder) and an aluminum cylinder are installed over an inner mold core. The inner mold core fills the air that air will flow through the throttle body. Method 700 proceeds to 722.

At 722, the inner mold core, steel sleeve, and aluminum cylinder are installed into an injection mold. The injection mold holds the outline of the integrated throttle body and the engine intake manifold such that they can be made in one piece. Method 700 proceeds to 724.

At 724, a short fiber reinforced polymer composite is injected into the injection mode and it is allowed to cure to a solid. Method 700 proceeds to 726.

At 726, the throttle body and engine intake manifold that are formed from the short fiber reinforced polymer composite are released from the mold and the inner core is removed from the throttle body and engine intake manifold. Method 700 proceeds to 728.

At 728, the integrated throttle body and engine intake manifold are bolted to an engine.

Thus, a throttle body and engine intake manifold may be formed without a gasket in between the throttle body and the engine intake manifold. Furthermore, bolts coupling the throttle body to the engine intake manifold may be eliminated.

Thus, the method of FIG. 7 provides for a method for manufacturing a system for directing and controlling air flow into an internal combustion engine, comprising driveline system, comprising: over molding a short fiber reinforced polymer composite throttle body housing over an aluminum cylinder that includes two bearing holders. In a first example, the method of manufacture further comprises installing a steel bearing within each of the two bearing holders. In a second example that may include the first example, the method of manufacture further comprises installing a steel bearing within each of the two bearing holders. In a third example that may include one or both of the first and second examples, the method of manufacture according further comprises installing gears and an electric motor into the short fiber reinforced polymer composite throttle body housing. In a third example that may include one or both of the first and second examples, the method of manufacture further comprises welding the short fiber reinforced polymer composite throttle body housing to a short fiber reinforced polymer composite intake manifold. In a fourth example that may include one or more of the first through third examples, the method of manufacture includes where the short fiber reinforced polymer composite throttle body housing is welded to the short fiber reinforced polymer composite intake manifold via vibration welding. In a fifth example that may include one or more of the first through fourth examples, the method of manufacture further comprises removing an inner core from the short fiber reinforced polymer composite throttle body housing. In a sixth example that may include one or more of the first through fifth examples, the method of manufacture includes wherein the short fiber reinforced polymer composite throttle body housing is formed via a single injection mold that includes an engine intake manifold.

The manufacturing methods and routines disclosed herein may be stored as executable instructions in non-transitory memory and may be carried out by a manufacturing system and/or a human. The manufacturing system may include a controller in combination with the various sensors and actuators. Further, portions of the methods may be physical actions taken in the real world to change a state of a device. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the system, where the described actions are carried out by executing the instructions in a system including the various hardware components in combination with the electronic controller. One or more of the method steps described herein may be omitted if desired.

While various embodiments have been described above, it should be understood that they have been presented by way of example, and not limitation nor restriction. It will be appreciated that the configurations and routines disclosed herein are exemplary in nature, and that these specific examples are not to be considered in a limiting sense, because numerous variations are possible. For example, the above technology can be applied to powertrains that include different types of propulsion sources including different types of electric machines, internal combustion engines, and/or transmissions.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

As used herein, the term "approximately" is construed to mean plus or minus five percent of the range, unless otherwise specified.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A system for directing and controlling air flow into an internal combustion engine, comprising:

a short fiber reinforced polymer composite intake manifold and a short fiber reinforced polymer composite throttle body housing, where the short fiber reinforced polymer composite throttle body housing is molded over an aluminum cylinder that includes two bearing holders, and where the two bearing holders are welded to the aluminum cylinder.

2. The system of claim 1, where the short fiber reinforced polymer composite intake manifold is welded to the short fiber reinforced polymer composite throttle body housing.

3. The system of claim 1, where the short fiber reinforced polymer composite intake manifold and the short fiber reinforced polymer composite throttle body housing are a one piece unit.

4. The system of claim 1, further comprising two bearings and a shaft.

5. The system of claim 1, further comprising a metal sleeve, and where the short fiber reinforced polymer composite throttle body housing is molded over the metal sleeve.

6. The system of claim 1, further comprising a flange included in the short fiber reinforced polymer composite throttle body housing, and where the short fiber reinforced polymer composite intake manifold is welded to the flange.

7. A method for manufacturing a system for directing and controlling air flow into an internal combustion engine, comprising a driveline system, comprising:

over molding a short fiber reinforced polymer composite throttle body housing over an aluminum cylinder that includes two bearing holders, where the short fiber reinforced polymer composite throttle body housing is formed via a single injection mold that includes an engine intake manifold.

8. The method of manufacture according to claim 7, further comprising installing a steel bearing within each of the two bearing holders.

9. The method of manufacture according to claim 7, further comprising installing gears and an electric motor into the short fiber reinforced polymer composite throttle body housing.

10. The method of manufacture according to claim 7, further comprising welding the short fiber reinforced polymer composite throttle body housing to a short fiber reinforced polymer composite intake manifold.

11. The method of manufacture according to claim 10, where the short fiber reinforced polymer composite throttle body housing is welded to the short fiber reinforced polymer composite intake manifold via vibration welding.

12. The method of manufacture according to claim 7, further comprising removing an inner core from the short fiber reinforced polymer composite throttle body housing.

13. A throttle body for an internal combustion engine, comprising:

a short fiber reinforced polymer composite throttle body housing molded over an aluminum cylinder that includes two bearing holders, the short fiber reinforced polymer composite throttle body housing including an over molded steel sleeve.

14. The throttle body of claim 13, where the two bearing holders are welded to the aluminum cylinder.

15. The throttle body of claim 14, further comprising a first bearing installed in a first of the two bearing holders and a second bearing installed in a second of the two bearing holders.

16. The throttle body of claim 13, further a comprising a short fiber reinforced polymer composite engine intake manifold welded to the short fiber reinforced polymer composite throttle body housing.

* * * * *